US006062044A

United States Patent [19]

Bernard et al.

[11] Patent Number: 6,062,044

[45] Date of Patent: May 16, 2000

[54] METHOD AND PLANT FOR PRODUCING AN AIR GAS WITH A VARIABLE FLOW RATE

[75] Inventors: Darredeau Bernard, Sartrouville; Guillard Alain, Paris, both of France

[73] Assignee: l'Air Liquide, Societe Anonyme pour l'Etude et l'Exploitation des Procedes Georges Claude, Paris Cedex, France

[21] Appl. No.: 09/230,332

[22] PCT Filed: Jul. 25, 1997

[86] PCT No.: PCT/FR97/01401

§ 371 Date: Mar. 30, 1999

§ 102(e) Date: Mar. 30, 1999

[87] PCT Pub. No.: WO98/04877

PCT Pub. Date: Feb. 5, 1998

[30] Foreign Application Priority Data

Jul. 25, 1996 [FR] France ..... 96 09376

[51] Int. Cl.[7] ..... F25J 3/00

[52] U.S. Cl. ..... 62/654; 62/647

[58] Field of Search ..... 62/654, 644, 646, 62/647

[56] References Cited

U.S. PATENT DOCUMENTS

| | | | |
|---|---|---|---|
| 5,082,482 | 1/1992 | Darredeau | 62/646 |
| 5,526,647 | 6/1996 | Grenier | 62/654 |
| 5,941,098 | 8/1999 | Guillard et al. | 62/656 |

FOREIGN PATENT DOCUMENTS

| | | |
|---|---|---|
| 0 422 974 | 4/1991 | European Pat. Off. . |
| 0 489 617 | 6/1992 | European Pat. Off. . |

*Primary Examiner*—William Doerrler
*Attorney, Agent, or Firm*—Young & Thompson

[57] ABSTRACT

A plant which, when used to produce pressurized oxygen gas, includes a switch, e.g. a liquid oxygen/liquid air switch, for meeting relatively long-term peak demand as well as short-term, high-amplitude peak demand, and a circuit (13, 30) for compressing oxygen to a pressure higher than the production pressure. This circuit leads to a buffer (15) at least partially meeting short-term, high-amplitude peak demand.

21 Claims, 3 Drawing Sheets

METHOD AND PLANT FOR PRODUCING AN AIR GAS WITH A VARIABLE FLOW RATE

FIELD OF THE INVENTION

The present invention relates to a process for producing a gas, in particular oxygen, from air at a variable flow rate by air distillation.

The invention applies in particular to the production of oxygen under pressure at a variable flow rate.

The pressures referred to here are absolute pressures and the flow rates are molar flow rates.

BACKGROUND OF THE INVENTION

EP-A-0,422,974 in the name of the Applicant Company describes a process of this type, called a "swinging-type process", intended for the production of gaseous oxygen at a variable flow rate. The second fluid involved is air to be distilled, which is condensed at a variable flow rate.

In this known process, it is easy to show that, in order to keep the supply and delivery flow rates of the distillation unit constant, it is necessary to vary the incoming air flow rate in the same direction as the variations in oxygen demand. If the oxygen is produced under pressure, the air which is condensed in order to vaporize the liquid oxygen is overpressured by an additional booster and, when the oxygen demand varies, it is necessary to vary significantly both the overpressured flow and the flow compressed by the main compressor.

Consequently, in this known process, the compressor, and optionally the booster, are oversized significantly with respect to the nominal oxygen flow rate to be produced. In addition, they work most of the time at considerably lower flow rates compared to their capacities and therefore with downgraded efficiency.

It has also been proposed to store gas to be produced, in gaseous form, in an auxiliary tank or "buffer", at a pressure greater than the production pressure. However, this approach is not satisfactory since it requires very large buffers to be installed in order to satisfy peaks in demand of long duration. In addition, producing all the gas at the buffer pressure is expensive in terms of energy.

OBJECT OF THE INVENTION

The object of the invention is to allow production of a gas from air at a variable flow rate under particularly efficient and economical conditions.

To this end, the subject matter of the invention is a process of the aforementioned type, characterized by the characterizing part of the first independent claim.

This process may include one or more of the characteristics disclosed in the dependent claims.

The subject of the invention is also a plant for implementing such a process. This plant is disclosed in second dependent claim.

This plant may include one or more of the characteristics disclosed in the second set of dependent claims.

BRIEF DESCRIPTION OF THE DRAWINGS

An example of how the invention is implemented will now be described with regard to the appended drawings, in which.

DETAILED DESCRIPTION OF THE INVENTION

Figure 1:
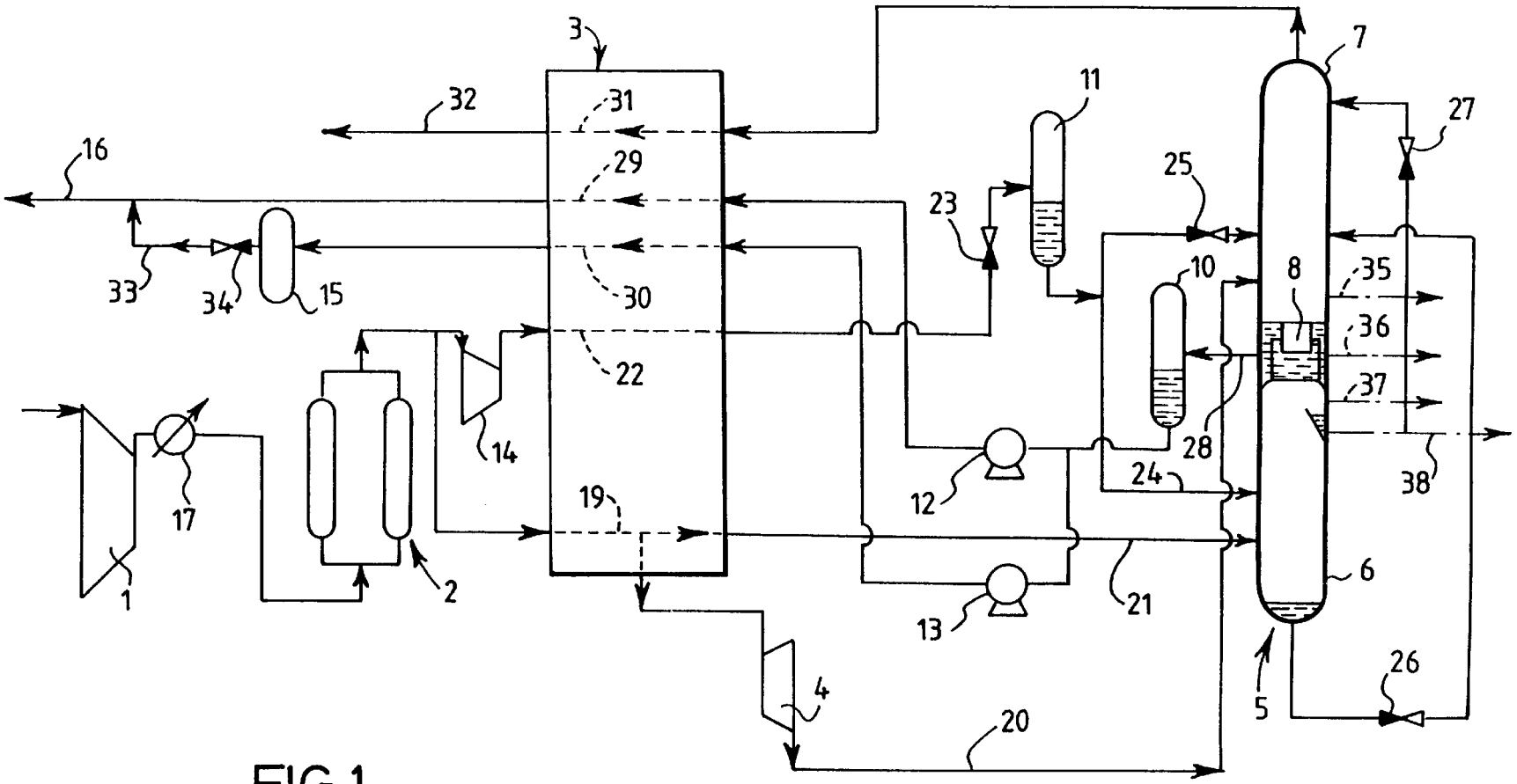
FIG. 1 shows diagrammatically a plant for producing oxygen under pressure at a variable flow rate according to the invention.

The plant shown in FIG. 1 essentially comprises a variable-flow main air compressor 1, for example of the moving-vane centrifugal type, an adsorption-type purification unit 2, a heat-exchanger 3, a cold-holding turbine 4, an air distillation unit 5 consisting of a double column, itself comprising a low-pressure column 7 and a vaporizer-condenser 8 on top of a medium-pressure column 6, a liquid-oxygen storage tank 10, a liquefied-air storage tank 11, two pumps 12 and 13, an air booster 14 and an auxiliary tank or "buffer" 15. This plant is intended to produce a variable flow rate of gaseous oxygen via a production line 16, at a pressure of approximately 15 bar.

In order to describe the operation of this plant, it will first of all be assumed that the gaseous oxygen demand in the line 16 is constant and equal to the nominal production rate, i.e. approximately 20% of the nominal flow rate of air compressed by the compressor 1.

The nominal flow rate of air to be treated, compressed to 6 bar by the compressor 1 and cooled to ambient temperature by an air-based or water-based cooler 17, is purified in the unit 2 and then divided into two streams, each having a constant flow rate.

A first stream is cooled in passages 19 in the exchanger 3; some of this is taken from this exchanger, after partial cooling, expanded to 1 bar in the turbine 4 and injected into the low-pressure column 7 near its dew point via a line 20; the rest continues to be cooled down to near its dew point at 6 bar and is then injected into the bottom of the medium-pressure column 6 via a line 21.

A second stream is overpressured in 14 to a high condensation pressure defined later, is then cooled and liquefied in passages 22 in the exchanger and then stored in liquid form in the storage tank 11 after expansion to 6 bar in an expansion valve 23. A constant flow of liquefied air is drawn off from the bottom of this tank and is divided into a first constant flow at 6 bar sent to the medium-pressure column via a line 24 and a second constant flow which is expanded to 1 bar in an expansion valve 25 and then injected into the low-pressure column 7.

The vaporizer-condenser 8 vaporizes a constant flow of liquid oxygen in the vessel in the low-pressure column 7 by condensation of an approximately equal flow of nitrogen from the top of the medium-pressure column 6. "Rich liquid" (oxygen-rich air) bled off from the vessel of the medium-pressure column and expanded to 1 bar in an expansion valve 26 is injected to an intermediate level of the low-pressure column, and "depleted liquid" (almost pure nitrogen) bled off from the top of the medium-pressure column and expanded to 1 bar in an expansion valve 27 is injected into the top of the low-pressure column.

A constant flow of liquid oxygen, corresponding to approximately 20% of the incoming air flow, passes via a line 28 into the storage tank 10. An identical constant flow of liquid oxygen is drawn off from the bottom of this storage tank and divided into two streams with constant flow rates:

- a larger first stream, representing for example 80% of the total flow, is compressed by the pump 12 to 15 bar, then vaporized in passages 29 in the exchanger and delivered to the production line 16;

a second stream is compressed by the pump 13 to a much greater pressure, for example 30 bar, vaporized in passages 30 in the exchanger and delivered to the tank 15. The tank 15 is connected to the production line 16 via a line 33 fitted with an expansion and flow-regulating valve 34, and a constant flow, equal to that of the aforementioned second stream, is expanded in this valve 34 and sent from the tank 15 to the line 16.

Furthermore, a constant flow of impure nitrogen, drawn off from the top of the low-pressure column, is warmed up in passages 31 in the exchanger and discharged as waste via a line 32.

As may be seen, the plant includes a single booster 14 so that the condensation of the over-pressured air is used, in the passages 22 in the exchanger, to vaporize both the oxygen at 15 bar and the oxygen at 30 bar.

To do this, the pressure of the over-pressured air is chosen as being that called the pressure "concomitant" with the vaporization of oxygen at 15 bar. This pressure is that for which the air-liquefaction knee G is close to the 15-bar oxygen vaporization plateau P as shown in FIG. 2, in which the amounts of heat exchanged Q are plotted as ordinates and the temperatures t as abscissae.

At this pressure, the aforementioned knee G is at a temperature below the 30-bar oxygen vaporization plateau P', as also illustrated in the diagram in FIG. 2, but this is entirely possible as long as a liquid product is simultaneously removed from the plant (liquid oxygen or nitrogen, in this example), according to the teaching of FR-A-2,674,011.

Figure 2:
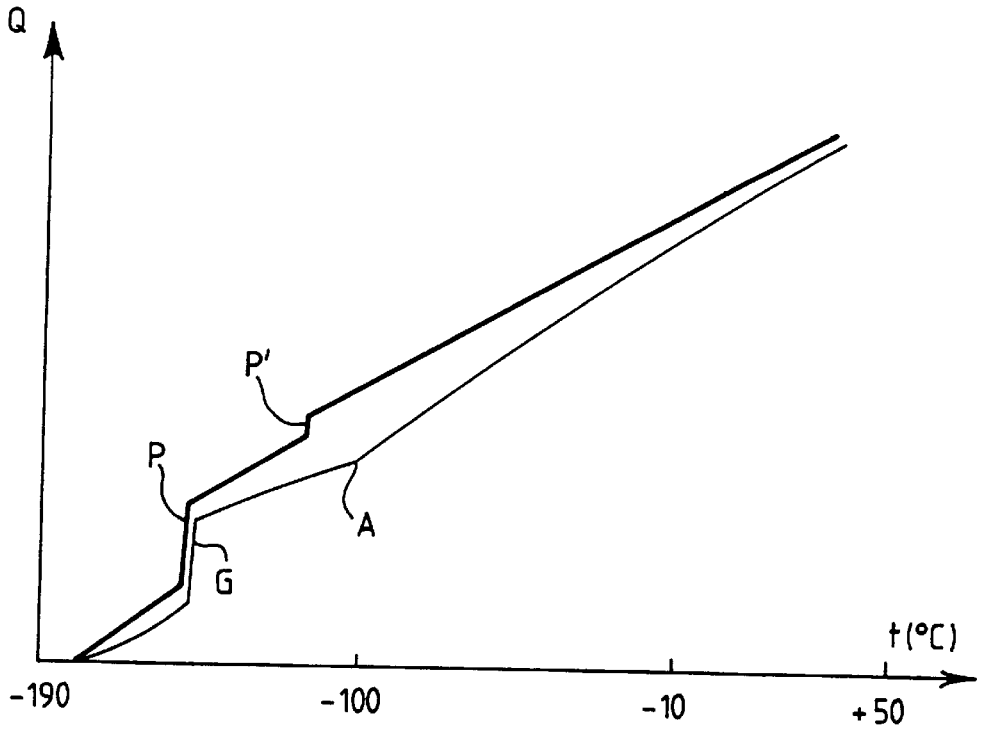
FIG. 2 is a heat-exchange diagram illustrating the vaporization of liquid oxygen at the production pressure.

In FIG. 2, the point A represents the inlet temperature of the turbine 4, and this inlet temperature is chosen so as to obtain a minimum temperature difference, of the order of a few degrees, at the hot end of the exchanger.

By way of numerical example, it is possible to choose a pressure of approximately 40 bar for the overpressured air.

All the lines which terminate in the double column 5 and all those which leave from it are fitted with means (not shown) for ensuring a constant flow rate. Thus, when the gaseous oxygen demand varies, the setting of this double column is not modified. In addition, the flow of oxygen vaporized in 30 at the high pressure remains constant.

When the oxygen demand increases, several cases may be distinguished:

(1) If the peak in demand is limited in terms of amplitude to a predetermined value, for example a value equal to 120% of the nominal flow rate, a corresponding additional flow of liquid oxygen is bled off from the storage tank 10 by means of the pump 12, thereby increasing the pumping rate of the latter, and vaporized in 29 at the production pressure by condensation, at 22, of air overpressured by the booster 14.

This corresponds to the conventional operation of the liquid-oxygen/liquid-air swinging process: the liquid-oxygen level goes down in the storage tank 10 while the level goes up in the storage tank 11.

(2) If the peak in demand is greater in terms of amplitude than the said predetermined value, two cases may be distinguished:

(a) If the duration of the peak in demand is short, the necessary additional oxygen flow, above the aforementioned value, is bled off from the tank 15, by opening the valve 34 wider, and sent, after expansion in this valve, to the production line 16.

For example, for a peak in demand equal to 160% of the nominal flow rate, 20% additional flow is delivered by the pump 12 and the remaining 40% by the tank 15.

(b) However, it will be understood that, when an additional flow is bled off from the tank 15, the pressure in the latter drops. Consequently, if the peak in demand has an excessive duration, the additional oxygen flow, compared to the nominal flow, must necessarily be delivered by external means, for example by an auxiliary store of oxygen.

It should be noted that the invention also applies to the following case: oxygen is produced at approximately 1 bar and the oxygen demand is always above a given minimum value. A constant flow of gaseous oxygen, equal to this minimum value, may then be drawn off directly from the bottom of the low-pressure column 7 via a line 35, as indicated by the dot-dash line in FIG. 1, and then warmed up in the exchanger. This variant makes it possible to reduce the capacity of the storage tanks 10 and 11. Likewise, liquid oxygen and/or gaseous nitrogen and/or liquid nitrogen may be simultaneously produced by the double column, via lines 36 and/or 37 and/or 38, as also indicated by the dot-dash lines in FIG. 1.

Other variants of the invention may be envisaged.

Figure 3:
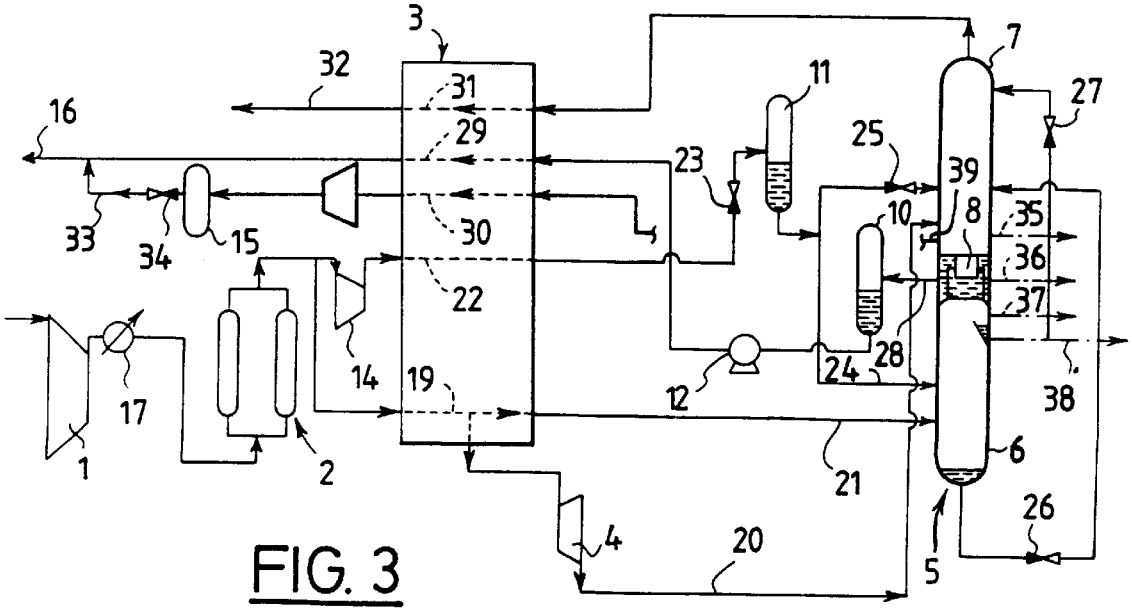
FIGS. 3 and 4 represent diagrammatically two alternative embodiments of the plant.

Thus, in the variant in FIG. 3, the pump 13 is omitted. The auxiliary flow of oxygen is drawn off in gaseous form from the vessel in the column 7, via a line 39, is warmed up at low pressure in 30 and then compressed to the high pressure by an auxiliary compressor 40 before being let into the cavity [sic] 15.

Also as a variant, the fluid for vaporizing at least one of the two flows of oxygen is nitrogen. In particular, in the variant in FIG. 4, in which oxygen is produced at approximately 1 bar, the vaporization of the main flow takes place by means of the vaporizer 8 in the double column. This main flow is then drawn off in gaseous form from the vessel in the column 7, via a line 41, and warmed up in 29. The delivery side of the pump 12 is then connected to the vessel in the column, which supplies the storage tank 10 under the effect of gravity.

In this case, the vaporization of the variable flow of oxygen produces a variable flow of liquid nitrogen in the column 6. For this reason, the line 38 is connected to a nitrogen storage tank 42 and the bottom of this storage tank is connected to a pump 43 for sending a variable flow of liquid nitrogen back into the top of the column 6.

In this variant, the process is an oxygen/nitrogen swinging process and the constant-level storage tank 11 may be omitted.

Figure 4:
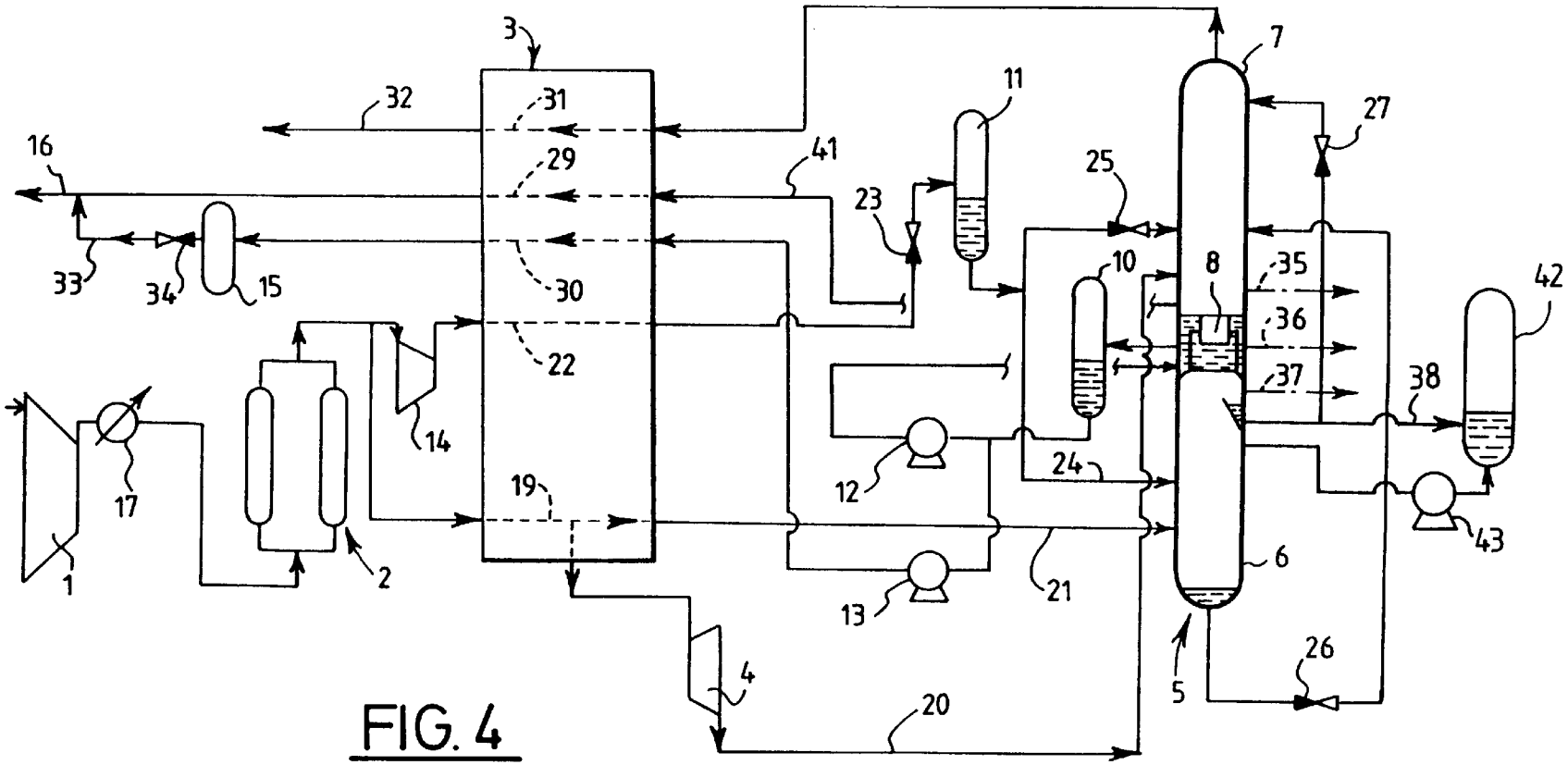

If the variants in FIGS. 3 and 4 are combined, there is no longer oxygen to be vaporized in the exchanger 3. Consequently, the elements 14, 22, 23, 11, 24 and 25 are omitted and all the incoming air is compressed to 6 bar in 1 and sent into the passages 19.

What is claimed is:

1. Process for producing a gas from air at a variable flow rate by air distillation in an air distillation unit, in which at least some of the gas to be produced is stored, in the form of a first liquid, in a first storage tank; a variable flow of said first liquid is drawn off from said storage tank and brought to gaseous form and to a production pressure, said variable flow being vaporized by condensing a corresponding variable flow of a second fluid; said condensed second fluid is stored, in the form of a second liquid, in a second storage tank; and a. controlled flow of said second liquid is sent to said. distillation unit, wherein an auxiliary flow of said gas to be produced is brought to gaseous form and to a high pressure greater than said production pressure and then stored in an auxiliary tank under said high pressure, and, during certain peaks in demand of the said gas, at least some of the demanded excess gas is bled off from said auxiliary tank, after having expanded said excess gas to said production pressure.

2. Process according to claim 1, wherein said auxiliary flow, in liquid form, is compressed to said high. pressure and said compressed auxiliary flow is vaporized at: said high pressure before letting it into said auxiliary tank.

3. Process according to claim 2, wherein said compressed auxiliary flow is vaporized by heat exchange with said second fluid.

4. Process according to claim 3, wherein said. variable flow and said auxiliary flow are vaporized by heat exchange with said second fluid at a single condensation pressure.

5. Process according to claim 4, wherein said single condensation pressure is such that the condensation temperature of said second fluid is less than a vaporization temperature of said gas, at least at said high pressure.

6. Process according to claim 5, wherein the condensation temperature of said second fluid at said condensation pressure is concomitant with the vaporization temperature of said gas at said production pressure.

7. Process according to claim 1, wherein a constant flow of said first liquid is drawn off from said distillation unit and a constant flow of said second liquid is sent from said second storage tank to said distillation unit.

8. Process according to claim 1, wherein said auxiliary flow represents a minor fraction of the flow of said first liquid under nominal running conditions.

9. Process according to claim 8, wherein said auxiliary flow represents approximately 25% of the flow of said first liquid under nominal running conditions.

10. Process according to claim 1, wherein said auxiliary flow has a constant flow rate.

11. Process according to claim 1, wherein said peaks in demand are peaks having an amplitude greater than a predetermined value.

12. Process according to claim 1, wherein up to a predetermined excess flow rate of said gas, said excess flow rate is achieved by increasing said variable flow rate.

13. Process according to claim 1, wherein said gas to be produced is oxygen.

14. Process according to claim 1, wherein said second fluid is air to be distilled in said air distillation unit.

15. Plant for producing a gas from air at a variable flow rate, comprising: an air distillation unit; a heat-exchanger for cooling the air to be distilled by heat exchange with products coming from said distillation unit; a first storage tank for storing said gas in the form of a first liquid; first means for drawing off a variable flow said first liquid from the first storage tank and bringing of said variable flow to gaseous form and to a production pressure, said first means comprising second means for vaporizing said variable flow by condensing a corresponding variable flow of a second fluid in the form of a second liquid; a second storage tank for storing the second liquid; third means for bringing an auxiliary flow of the gas to be produced to gaseous form and to a high pressure greater than said production pressure, and then letting said auxiliary flow into an auxiliary tank; and a line provided with an expansion and flow-regulating valve and connecting said auxiliary tank to a production line of the plant.

16. Plant according to claim 15, wherein said third means comprise a pump for compressing said auxiliary flow in liquid form and means for vaporizing said compressed auxiliary flow.

17. Plant according to claim 16, wherein said pump is connected to said first storage tank.

18. Plant according to claim 16, comprising a single booster bringing said second fluid to a single condensation pressure by heat exchange with said variable flow and with said auxiliary flow.

19. Plant according to claim 15, comprising drawing-off means designed to draw off a constant flow of said first liquid from said distillation unit and means for sending a constant flow of said second liquid from said second storage tank to said distillation unit.

20. Plant according to claim 15, wherein said gas to be produced is oxygen.

21. Plant according to claim 15, wherein said second fluid is air to be distilled in said air distillation unit.

* * * * *

UNITED STATES PATENT AND TRADEMARK OFFICE

CERTIFICATE OF CORRECTION

PATENT NO. : 6,062,044

DATED : May 16, 2000

INVENTOR(S) : Bernard DARREDEAU et al.

It is certified that error appears in the above-indentified patent and that said Letters Patent is hereby corrected as shown below:

On the title page, in Item [75], change "Darredeau Bernard" to --Bernard Darredeau-- and "Guillard Alain" to --Alain Guillard--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*